United States Patent [19]

Moote et al.

[11] Patent Number: 5,003,944

[45] Date of Patent: Apr. 2, 1991

[54] TRANSITION FUEL MULTIPLIER

[75] Inventors: Richard K. Moote, Ann Arbor; Gregory T. Weber, Farmington Hills; William O. Robinson, Detroit, all of Mich.

[73] Assignee: Chrysler Corporation, Highland Park, Mich.

[21] Appl. No.: 522,624

[22] Filed: May 14, 1990

[51] Int. Cl.[5] ..... F02D 41/04

[52] U.S. Cl. ..... 123/299; 123/478; 123/492

[58] Field of Search ..... 123/299, 476, 478, 480, 123/486, 488, 490, 492, 493; 364/431.05

[56] References Cited

U.S. PATENT DOCUMENTS

| | | | |
|---|---|---|---|
| 3,749,065 | 7/1973 | Rothfusz et al. | 123/492 |
| 4,602,603 | 7/1986 | Honkanen et al. | 123/416 |
| 4,640,253 | 2/1987 | Kamai | 123/478 X |
| 4,718,387 | 1/1988 | Shinchi et al. | 123/478 |
| 4,721,086 | 1/1988 | Scarnera et al. | 123/478 |
| 4,785,784 | 11/1988 | Nanyoshi et al. | 123/478 |
| 4,889,100 | 12/1989 | Nakaniwa et al. | 123/478 X |
| 4,915,078 | 4/1990 | Sonoda et al. | 123/478 |

*Primary Examiner*—Willis R. Wolfe
*Attorney, Agent, or Firm*—Mark P. Calcaterra

[57] ABSTRACT

The present invention is a method of firing fuel injectors for an engine of an automotive vehicle. The method includes the steps of determining whether injection timing for firing fuel injectors has changed from one predetermined state to another predetermined state of a distributor reference signal, firing the injectors for a predetermined time period and delivering a calculated amount of fuel for the one predetermined state if the injection timing has not changed. The method also includes determining whether a need for transition fuel has ended if the injection timing has changed and firing the fuel injectors for another predetermined time period and delivering a calculated amount of transition fuel at another predetermined state if the need for transition fuel has not ended. The method further includes firing the fuel injectors for another predetermined time period and delivering a calculated amount of fuel for the another predetermined state either after completion of the firing of transition fuel or if the need for transition fuel has ended.

2 Claims, 3 Drawing Sheets

TRANSITION FUEL MULTIPLIER

BACKGROUND OF THE INVENTION

1. Field of the Invention

The present invention relates generally to fuel injection for engines of automotive vehicles, and more particularly to, a method for firing a fuel injector on an engine of an automotive vehicle.

2. Description of Related Art

Typically, an engine of an automotive vehicle has one or more fuel injectors for delivering fuel from a fuel source to cylinders of an internal combustion engine. Generally, a sensor on a distributor of the engine transmits a signal from the distributor as to the crank angle of the engine. This distributor reference signal is received by an electronic control unit (ECU) which outputs a signal to fire the fuel injectors at predetermined states of the distributor reference signal. One predetermined state may be a "zero degree" or "falling" edge of the distributor reference signal as illustrated by reference letter A in FIG. 1. Previously, these fuel injectors were fired in pairs, e.g. two at a time, at the predetermined state. This type of fuel injection is termed "two-group" or "banked" fuel injection.

Fuel injector firing at the zero degree edge of the distributor reference signal is optimum for peak performance of the engine (e.g., open throttle, vehicle moving). However, fuel injector firing may occur at another predetermined state. This predetermined state may be an "eighty-three (83) degree" or "rising" edge of the distributor reference signal as illustrated by reference letter B in FIG. 1. Fuel injector firing at the eighty-three degree edge of the distributor reference signal is optimum for idle quality (e.g., closed throttle, vehicle not moving). The fuel injectors may be fired sequentially, e.g. one at a time, at the predetermined states. This type of fuel injection is termed "bi-modal sequential" fuel injection.

One problem that occurs in fuel injection timing is the transfer from one predetermined state to another predetermined state for firing the fuel injectors; that is, the transfer from the zero degree edge to the eighty-three edge of the distributor reference signal for firing the fuel injectors in bi-modal sequential fuel injection. This problem results in a lean engine operating condition. Moreover, a closed throttle bucking/engine RPM undershooting may result from the lean engine operating condition any time a transfer from open to closed throttle occurs.

SUMMARY OF THE INVENTION

It is, therefore, one object of the present invention to provide a method of firing fuel injectors for an engine of an automotive vehicle for bi-modal sequential fuel injection.

It is another object of the present invention to eliminate a lean engine operating condition for firing fuel injectors as a result of transferring from one predetermined state to another predetermined state of the crank angle for fuel injection timing.

It is yet another object of the present invention to eliminate a lean operating condition of an engine as a result of firing fuel injectors at a zero and eighty-three degree edge of a distributor reference signal for the crank angle.

It is a further object of the present invention to eliminate the driveability problem of engine bucking/undershooting that may result from a lean engine operating condition.

To achieve the foregoing objects, the present invention is a method of firing fuel injectors for an engine of an automotive vehicle. The method includes the steps of determining whether injection timing for firing fuel injectors has changed from one predetermined state to another predetermined state of a distributor reference signal and firing the fuel injectors for a predetermined time period and delivering normal calculated amount of fuel for the one predetermined state if the injection timing has not changed. The method also includes determining whether a need for transition fuel has ended if injection timing has changed and firing the fuel injectors for another predetermined time period and delivering transition fuel at another predetermined state if the need for transition fuel has not ended. The method further includes firing the fuel injectors for another predetermined time period and delivering a calculated amount of fuel at another predetermined state either after completion of the firing of transition fuel or if the need for transition fuel has ended.

One advantage of the present invention is that the fuel injectors are fired in bi-modal sequential operation. Another advantage of the present invention is that a lean operating condition is eliminated when transferring from one predetermined state to another predetermined state of the crank angle for fuel injection timing. Yet another advantage of the present invention is that a percentage of calculated fuel for the eighty three degree edge is delivered at the zero degree edge following an open to closed throttle transfer. As a result, a lean operating condition of the engine is eliminated. A further advantage of the present invention is that the transition fuel eliminates the lean operating condition, thereby eliminating the driveability problem of engine bucking/undershooting.

Other objects, features and advantages of the present invention will be readily appreciated as the same becomes better understood after reading the following description in light of the accompanying drawings.

DESCRIPTION OF THE PREFERRED EMBODIMENT(S)

Figure 2:
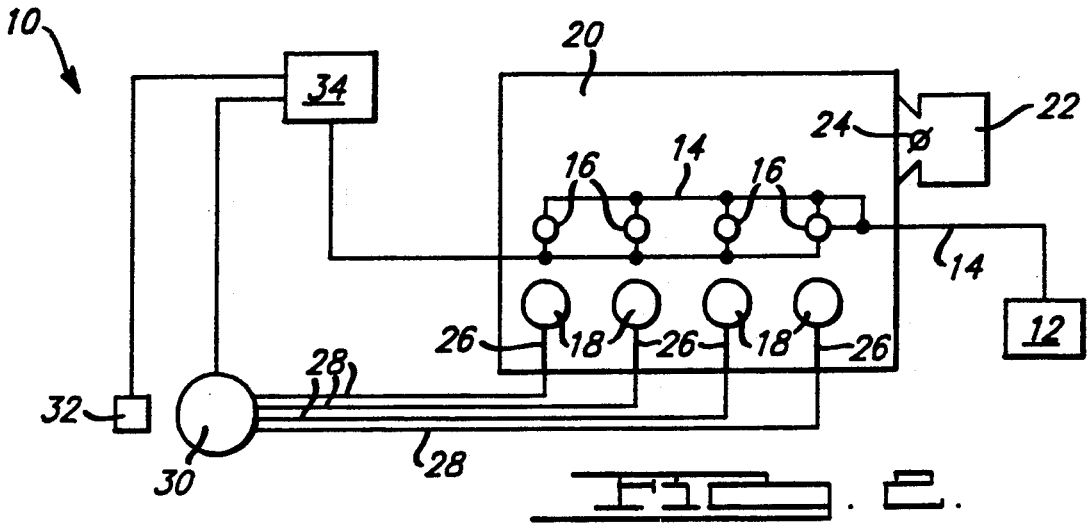
FIG. 2 is a schematic view of a fuel injection system incorporating the present invention.

Referring to FIG. 2, a schematic view of a fuel injection system 10 is shown for an automotive vehicle (not shown). Under normal operating conditions, fuel is delivered from a fuel source 12 through fuel lines 14 to at least a pair of fuel injectors or actuators 16. The fuel injectors 16 are conventional and inject fuel from fuel lines 14 into individual cylinders 18 of an internal combustion engine 20 of the automotive vehicle. In the preferred embodiment, the engine 20 has four cylinders 18. The fuel injection system 10 also includes a throttle body 22 having a throttle valve 24. The throttle valve 24 is opened, closed or at a position therebetween for allowing or preventing air to enter the cylinders 18 of the engine 20. Fuel from the fuel injectors 16 is mixed with air in the cylinders 18 in a known manner.

The fuel injection system 10 further includes a spark plug 26 for each cylinder 18 of the engine 20. The spark plug 26 is connected by a plug wire 28 to a distributor 30. The distributor 30 sends an electrical signal to the spark plugs 26 to ignite the fuel and air mixture in the cylinders 18 at predetermined time intervals. A sensor 32, such as a Hall-Effect sensor, is located near the distributor 30. An example of such a sensor and distributor may be found in U.S. Pat. No. 4,602,603, issued Jul. 29, 1986, to Honkanen et al. and assigned to the same assignee as the present invention, the disclosed material of which is hereby incorporated by reference.

Figure 5:
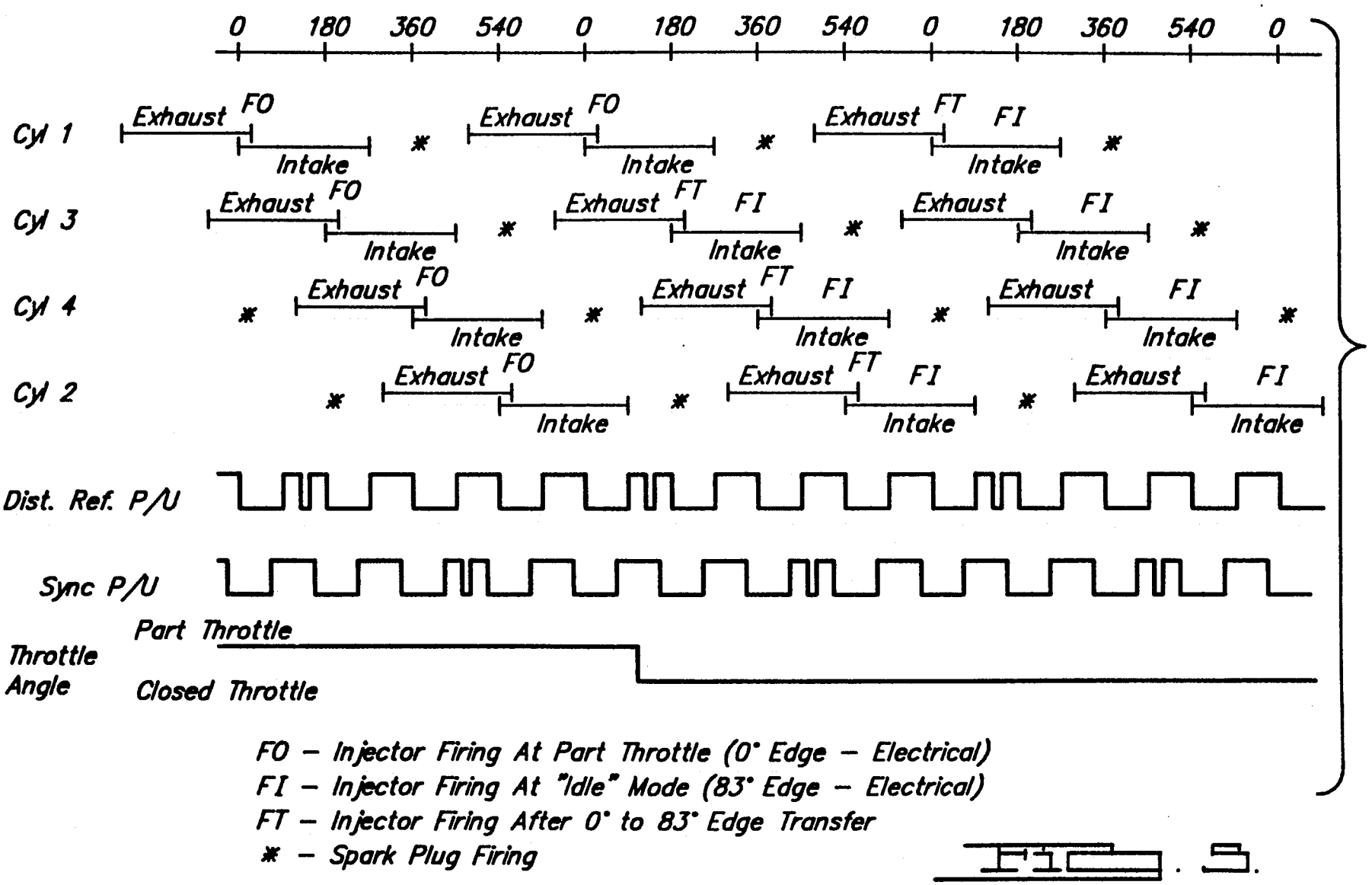
FIG. 5 is a view similar to FIG. 1 illustrating crank angle, cylinder firing, distributor signals, and throttle angle according to the present invention for a four cylinder engine of an automotive vehicle.

The sensor 32 and distributor 30 are electrically connected to an electronic control unit (ECU) 34 which receives a pickup or distributor reference signal of the crank angle or position of the engine 20. The ECU 34 outputs a signal to the distributor 30 to fire the spark plugs 26. The fuel injectors 16 are also electrically connected to the ECU 34 which outputs a signal to fire the fuel injectors 16. The fuel injectors 16 are fired sequentially, e.g. one at a time, for bi-modal sequential fuel injection. The ECU 34 fires the fuel injector 16 for each cylinder 18 at a first predetermined state (FO) such as the zero degree (0°) edge of the distributor reference signal when the throttle valve 20 is open such as at part throttle as illustrated in FIG. 5. The ECU also fires the fuel injector 16 for each cylinder 18 at a second predetermined state (FI) such as the eighty-three degree (83°) edge of the distributor reference signal when the throttle valve 20 is closed. The ECU 34 further fires the spark plug 26 for each cylinder 18 after the intake stroke as illustrated by the asterisk (*) in FIG. 5. The ECU 34 also fires the fuel injector 16 for each cylinder 18 at a predetermined state (FT) such as a zero degree (0°) edge of the distributor reference signal after a zero to eighty-three transfer.

Figure 1:
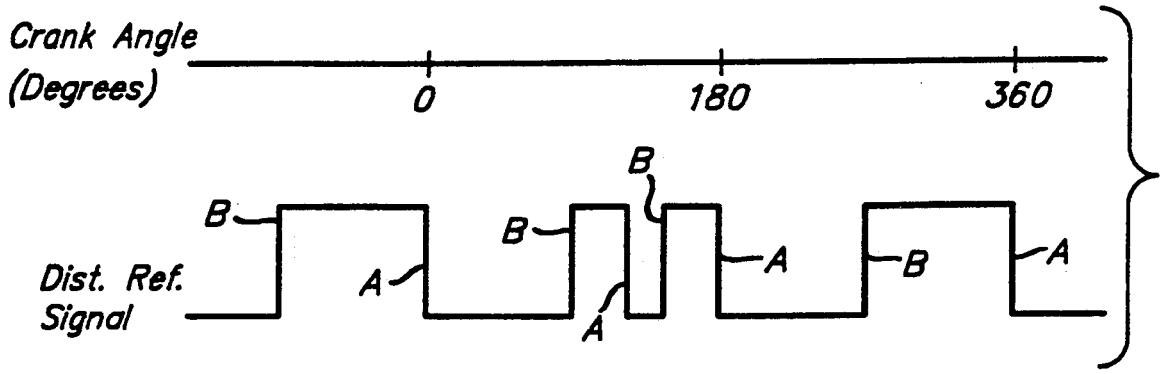
FIG. 1 is a view illustrating crank angle position and distributor reference signal on an engine for an automotive vehicle.
Figure 4:
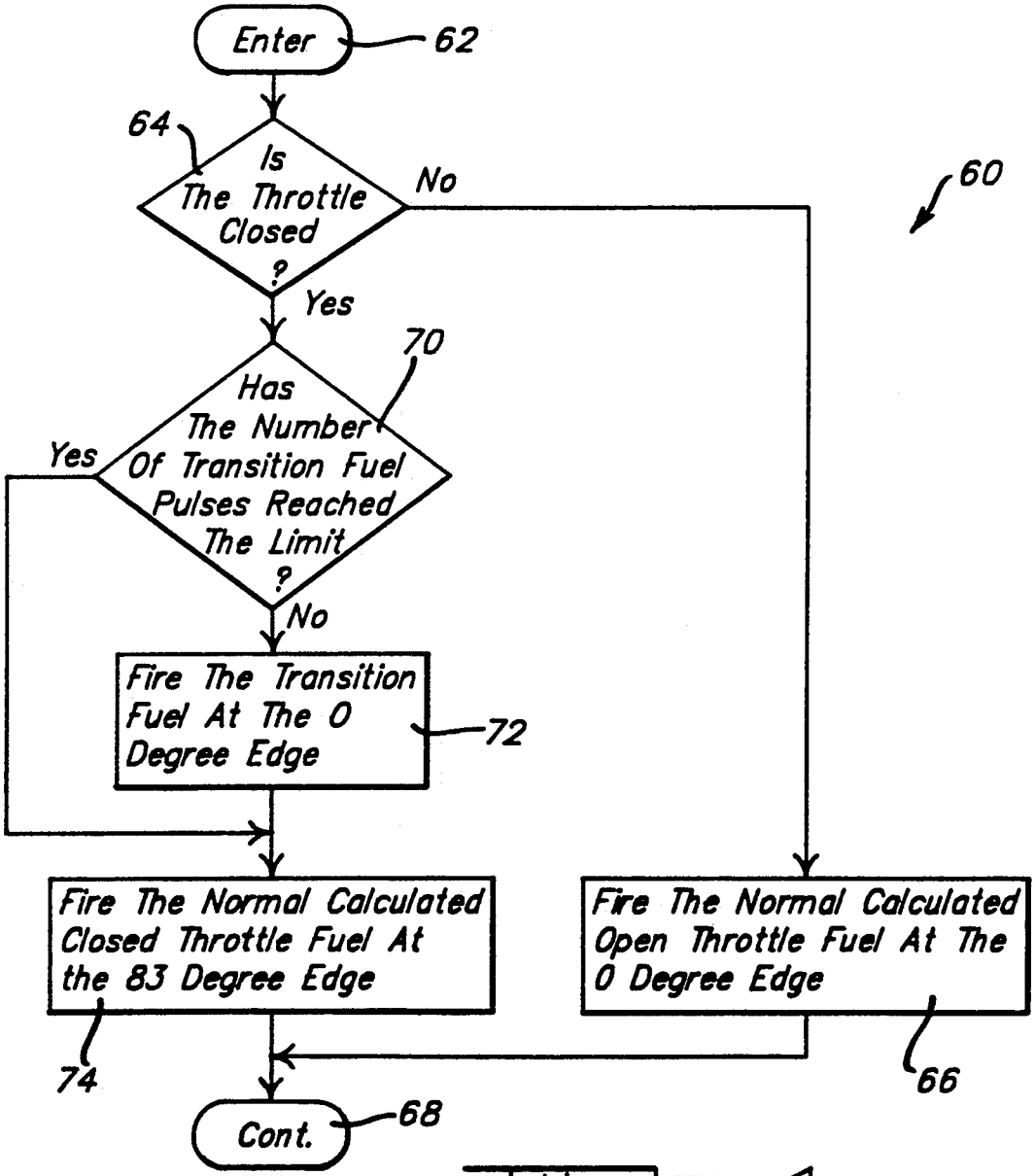
FIG. 4 is a flowchart of a specific method of firing fuel injectors according to the present invention.
Figure 3:
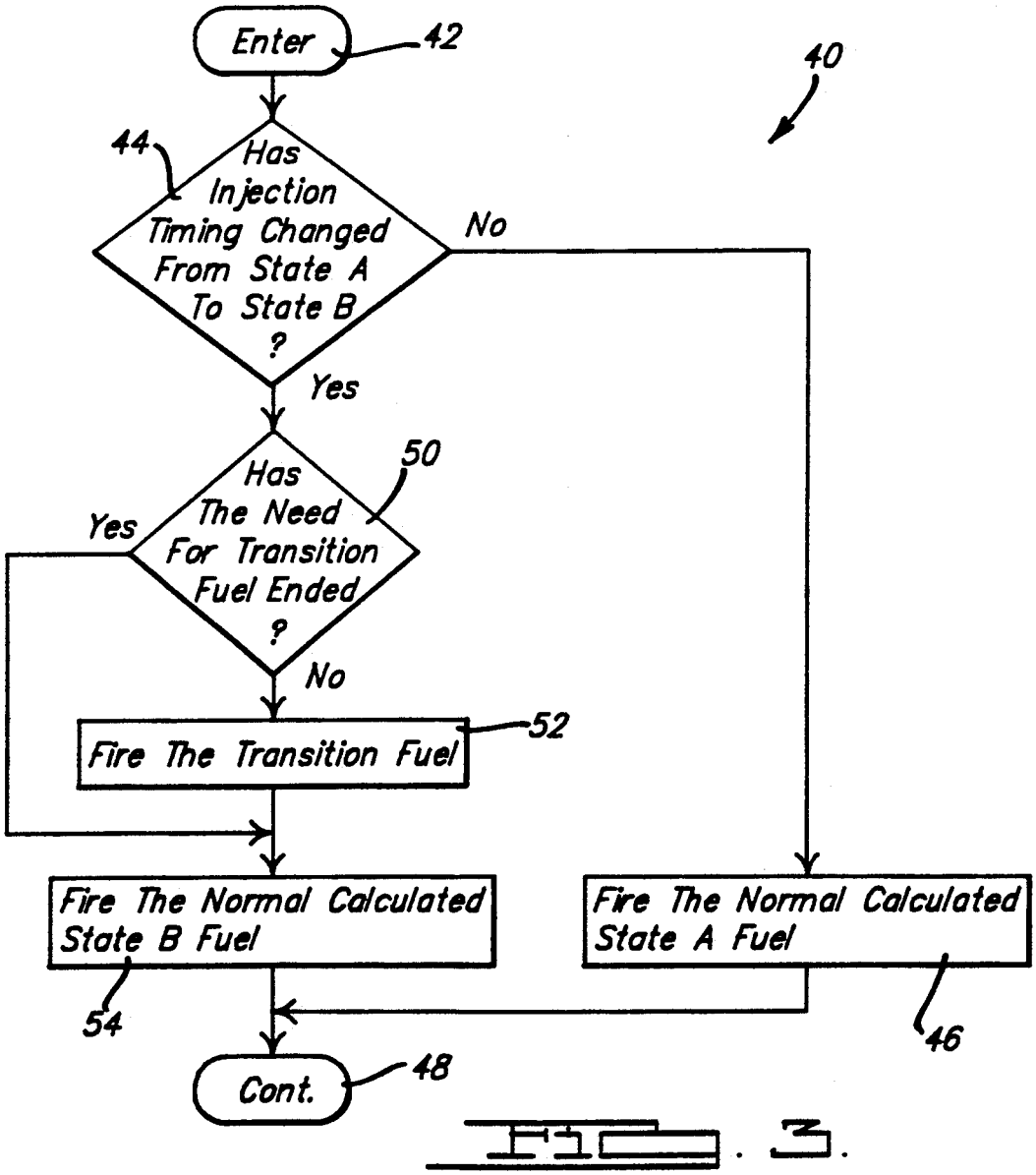
FIG. 3 is a flowchart of a method of firing fuel injectors according to the present invention.

Referring to FIG. 3, a flowchart 40 for a method of firing at least two or more fuel injectors 16 for bi-modal sequential fuel injection is shown. The purpose of the methodology is to deliver fuel to the fuel injector of each cylinder each time a transfer from one predetermined state to another predetermined state of the crank angle for firing the fuel injector occurs. The methodology enters through bubble 42 and advances to diamond 44 to determine whether the injection timing for firing the fuel injectors 16 has changed from one predetermined state A to another predetermined state B as illustrated in FIG. 1. The ECU 34 determines the change in injection timing by throttle angle position, manifold absolute pressure (MAP), etc. It should be appreciated that suitable transducers or sensors electrically connected to the ECU 34 to provide measurement data of throttle angle, MAP, etc.

If the injection timing has not changed, the methodology advances to block 46 and fires the fuel injector 16 of a particular cylinder 18 for a predetermined time period to deliver a calculated amount of fuel at predetermined state A to the cylinder 18. This is accomplished by the ECU 34 sending a signal to the fuel injector 16 to actuate or fire the fuel injector 16 for a predetermined time period at the predetermined state. The calculated amount of fuel is based on empirical data or the like. The methodology then advances to bubble 48 and continues.

In diamond 44, if the injection timing has changed, the methodology advances to diamond 50 and determines whether the need for transition fuel has ended. The ECU 34 accomplishes this by throttle angle position, engine revolutions, etc. If the need for transition fuel has not ended, the methodology advances to block 52 and fires the fuel injector 16 for the particular cylinder 18 with a calculated amount of transition fuel at the predetermined state A. In other words, the ECU 34 calculates a percentage of fuel to be delivered by the fuel injector 16 at predetermined state B based on engine speed and delivers this transition fuel at predetermined state A. It should be appreciated that a look-up table of percentage of fuel versus engine speed may be stored in memory and used by the ECU 34.

When the methodology is completed in block 52 or the need for transition fuel has ended in diamond 50, the methodology advances to block 54 and fires the fuel injector 16 of a particular cylinder 18 for a predetermined time period to deliver a calculated amount of fuel at predetermined state B. The methodology then advances to bubble 48 and continues. It should be appreciated that the calculated amount of fuel for predetermined state B is based on empirical data or the like. It should also be appreciated that the spark advance could be varied as opposed to fuel or a combination of spark advance and fuel could be varied.

Referring to FIG. 3, a flowchart 60 for a specific method of firing at least two or more fuel injectors 16 for bi-modal sequential fuel injection is shown. The methodology enters through bubble 62 and advances to diamond 64 to determine whether the throttle valve 24 is closed. The ECU 34 reads a throttle position sensor (not shown) to determine the angular position of the throttle valve 24. If the throttle valve 24 is not closed, the methodology advances to block 66 and fires the fuel injector 16 for a particular cylinder 18 for a to deliver a calculated amount of fuel at the zero degree edge of the distributor reference signal for the crank angle. This is accomplished by the ECU 34 sending a signal to the fuel injector 16 to actuate or fire the fuel injector 16 for a predetermined time period. The methodology then advances to bubble 68 and continues.

In diamond 64, if the throttle valve 24 is closed, the methodology advances to diamond 70 and determines whether a predetermined number of transition fuel pulses has reached a predetermined number or limit. The ECU 34 has a counter (not shown) which counts injector pulses or firings. Preferably, the ECU 34 counts the number of rising and falling edges of the distributor reference signal for the zero and eighty-three degree edge for each cylinder 18 for a limit of four. If the predetermined limit has not been reached, the methodology advances to block 72 and fires the fuel injector 16 for the particular cylinder 18 with a calculated amount of transition fuel at the zero degree edge of the distributor reference signal. In other words, the ECU 34 calculates a percentage of fuel to be delivered by the fuel injector 16 at the zero degree edge of the distributor reference signal following a transfer from zero to eighty-three degree in injection timing. This calculation is a percentage of fuel which is to be delivered at the eighty-three degree edge following the part open to closed throttle transfer and delivers this transition fuel at the zero degree edge. Said another way, the ECU 34 takes a percentage of the calculated closed throttle fuel and delivers that fuel on the zero degree edge (for a predetermined number of zero degree edges) in addition to delivering the eighty-three degree edge fuel normally associated with closed throttle engine operation.

When the methodology is completed in block 72 or the number of transition fuel pulses has reached the predetermined limit in diamond 70, the methodology advances to block 74 and fires the fuel injector 16 of a particular cylinder 18 for a predetermined time period and delivers a calculated amount of fuel at the eighty-three degree edge of the distributor reference signal. The methodology then advances to bubble 68 and continues.

Accordingly, the present invention provides transition fuel to eliminate a lean operating condition following a transfer from part to closed throttle as illustrated in FIG. 5. The elimination of the lean operating condition, in turn, eliminates the driveability problem of engine bucking/undershooting.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. In a fuel injection system for an engine of an automotive vehicle including a plurality of cylinders, a spark plug for each of the plurality of cylinders, a distributor electrically connected to the spark plug, a throttle body having a throttle valve connected to the engine to allow or prevent air to the plurality of cylinders, a fuel source, at least one fuel line connected to the fuel source, a plurality of fuel injectors connected to the fuel line for delivering fuel to the plurality of cylinders, a sensor located near the distributor for sensing predetermined states of the distributor (A and B), and an electronic control unit (ECU) electrically connected to the sensor, distributor and fuel injectors for receiving signals from the sensor and outputting signals to fire the distributor and fuel injectors, a method of firing the fuel injectors, said method comprising the steps of:

determining whether injection timing for firing the fuel injectors has changed from predetermined state A to predetermined state B of a distributor reference signal;

firing the fuel injectors for a predetermined time period and delivering a calculated amount of fuel at predetermined state A if injection timing has not changed;

determining whether a need for transition fuel has ended if injection timing has changed;

firing the fuel injectors for another predetermined time period and delivering a calculated amount of transition fuel at predetermined state B if the need for transition fuel has not ended; and firing the fuel injectors for another predetermined time period and delivering a calculated amount of fuel at the predetermined state B if either said firing of transition fuel has been completed or if the need for transition fuel has ended.

2. In a fuel injection system for an engine of an automotive vehicle including a plurality of cylinders, a spark plug for each of the plurality of cylinders, a distributor electrically connected to the spark plug, a throttle body having a throttle valve connected to the engine to allow or prevent air to the plurality of cylinders, a fuel source, at least one fuel line connected to the fuel source, a plurality of fuel injectors connected to the fuel line for delivering fuel to the cylinders, a sensor located near the distributor for sensing a zero degree edge and eighty-three degree edge of a distributor reference signal, and an electronic control unit (ECU) electrically connected to the sensor, distributor and fuel injectors for receiving signals from the sensor and outputting signals to fire the distributor and fuel injectors, a method of firing the fuel injectors, said method comprising the steps of:

determining whether the throttle valve is closed by the ECU;

firing the fuel injectors by the ECU for a predetermined time period and delivering a calculated amount of fuel at the zero degree edge of the distributor reference signal if the throttle valve is not closed;

determining whether a number of transition fuel pulses has reached a predetermined limit if the throttle valve is closed;

firing the fuel injectors for another predetermined time period and delivering a calculated amount of transition fuel at the zero degree edge of the distributor reference signal if the number of transition fuel pulses has not reached the predetermined limit; and firing the fuel injectors for another predetermined time period and delivering another calculated amount of fuel at the eighty-three degree edge of the distributor reference signal if either said firing transition fuel has been completed or the number of transition fuel pulses has reached the predetermined limit.

* * * * *